US005913187A

United States Patent [19]

Mermelstein

[11] Patent Number: 5,913,187

[45] Date of Patent: Jun. 15, 1999

[54] NONLINEAR FILTER FOR NOISE SUPPRESSION IN LINEAR PREDICTION SPEECH PROCESSING DEVICES

[75] Inventor: Paul Mermelstein, Côte St-Luc, Canada

[73] Assignee: Nortel Networks Corporation, Montreal, Canada

[21] Appl. No.: 08/920,724

[22] Filed: Aug. 29, 1997

[51] Int. Cl.[6] ..... G10L 9/14

[52] U.S. Cl. ..... 704/219; 704/223

[58] Field of Search ..... 704/219, 220, 704/223, 230, 226, 262, 264, 266

[56] References Cited

U.S. PATENT DOCUMENTS

| | | | |
|---|---|---|---|
| 5,206,884 | 4/1993 | Bhaskar | 375/34 |
| 5,444,816 | 8/1995 | Adoul et al. | 704/219 |
| 5,699,482 | 12/1997 | Adoul et al. | 704/219 |
| 5,708,756 | 1/1998 | Wang et al. | 704/220 |
| 5,774,837 | 6/1998 | Yeldener et al. | 704/208 |

OTHER PUBLICATIONS

Man M. Sondhi, "New Methods of Pitch Extraction", Reprint from *IEEE Trans. Audio Electroacoust.*, vol. AU–16, pp. 252–266, Jun. 1968: [pp. 153–157 submitted].

Tomohiko Taniguchi, et al., "Pitch Sharpening for Perceptually Improved CELP and the Sparse–Delta Codebook for Reduced Computation", *IEEE*, pp. 241–244, 1991.

*Primary Examiner*—Richemond Dorvil

[57] ABSTRACT

The invention relates to a linear prediction audio signal processing apparatus, such as a vocoder, including a nonlinear filter to attenuate the residual signal used to excite a linear prediction synthesis filter. The nonlinear filter is capable of reducing the noise component in the signal while keeping only the periodic component of the speech signal. This feature enhances speech quality. The invention also extends to a novel method for processing a residual signal used to excite a linear prediction synthesis filter in order to attenuate wide band additive noise in the speech signal as constructed by the synthesis filter.

15 Claims, 13 Drawing Sheets

NONLINEAR FILTER FOR NOISE SUPPRESSION IN LINEAR PREDICTION SPEECH PROCESSING DEVICES

FIELD OF THE INVENTION

This invention relates to the field of processing audio signals, such as speech signals that have been compressed or encoded with a digital signal processing technique. More specifically, the invention relates to a method and an apparatus for nonlinear filtering a residual signal capable of exciting a linear prediction synthesis filter to construct an audio signal.

BACKGROUND OF THE INVENTION

When an audio signal is compressed by an encoder, such as by a code excited linear prediction (CELP) type encoder the additive noise that may be present in the background when the audio signal is recorded, will be processed with the speech signal. This noise component is not desirable because it contributes to degrade the speech quality when a decoder processes the compressed audio signal in order to build a replica of the original signal. In this context, reducing the noise component in the signal while keeping only the periodic component of the speech signal would greatly enhance the speech quality.

At present, one of the techniques used for noise reduction is called center-clipping. With this technique, distortions may be introduced into the speech signal due to a disturbance in the short-term correlation properties, or, viewed in the frequency domain, distortions in successive short-term spectra may result. In contrast, the LPC residual is spectrum flattened and minor nonlinear operations do not introduce significant changes in the spectral shapes.

Thus, there exists a need in the industry to provide a method and an apparatus for enhancing speech quality by reducing noise that may be present in the speech signal.

OBJECTS AND STATEMENT OF THE INVENTION

An object of the invention is to improve an audio signal processing device, such as a Linear Predictive (LP) encoder or a LP decoder, by providing a means in the audio signal processing device to reduce the perceptual effect of noise in the audio signal.

Another object of the invention is to provide a method for processing a residual signal capable of exciting a linear prediction synthesis filter to generate a replica of an audio signal, so as to reduce the perceptual effect of noise in the audio signal output by the synthesis filter.

As embodied and broadly described herein, the invention provides an improvement to an audio signal processing apparatus including means for generating a residual signal for use in exciting a linear prediction filter to generate a replica of an audio signal, the improvement comprising a non-linear filter that includes:

an input for receiving the residual signal;

a residual signal processing means coupled to said input for receiving the residual signal, said residual signal processing means having a transfer function that causes an attenuation of the residual signal, said transfer function establishing a degree of amplitude attenuation that varies in a non-linear manner with the amplitude of the residual signal; and an output coupled to said residual signal processing means for outputting the residual signal altered by said residual signal processing means.

In this specification, the term "coefficient segment" is intended to refer to any set of coefficients that uniquely defines a filter function which models the human vocal tract. It also refers to any type of information format from which the coefficients may indirectly be extracted. In conventional vocoders, several different types of coefficients are known, including reflection coefficients, arcsines of the reflection coefficients, line spectrum pairs, log area ratios, among others. These different types of coefficients are usually related by mathematical transformations and have different properties that suit them to different applications. Thus, the term "coefficient segment" is intended to encompass any of these types of coefficients.

The "excitation segment" can be defined as information that needs to be combined with the coefficients segment in order to provide a complete representation of the audio signal. It also refers to any type of information format from which the excitation may indirectly be extracted. The excitation segment complements the coefficients segment when synthesizing the signal to obtain a signal in a non-compressed form such as in PCM sample representations. Such excitation segment may include parametric information describing the periodicity of the speech signal, an excitation signal as computed by the encoder of a vocoder, speech framing control information to ensure synchronous framing in the decoder associated with the remote vocoder, pitch periods, pitch lags, gains and relative gains, among others.

The coefficient segment and the excitation segment can be represented in various ways in the signal transmitted through the network of the telephone company. One possibility is to transmit the information as such, in other words a sequence of bits that represents the values of the parameters to be communicated. Another possibility is to transmit a list of indices that do not convey by themselves the parameters of the digitized form of the speech signal, but simply constitute entries in a database or codebook allowing the decoder of the vocoder to lookup this database and extract, on the basis of the various indices received, the pertinent information to construct the digitized form of the speech signal.

In the most preferred embodiment of this invention, the non-linear filter stage is incorporated in the encoder stage of a CELP vocoder. In this type of vocoder, the incoming speech is digitized and used to generate a spectrum-flattened residual signal by linear prediction. Periodicity is removed from the residual signal through use of pitch prediction filter (open-loop pitch predictor) or the incoming signal is partially matched with the aid of past excitation passed through a pitch synthesis filter (closed-loop pitch prediction). Sections of the signal corresponding to vowels generally show strong pitch periodicity and therefore high pitch prediction gain. If adaptive and stochastic codebooks are used to synthesize a replica of the incoming signal, for sustained voiced segments the relative contribution of the adaptive codebook is higher than that of the stochastic codebook. Near the onset of the voicing, however, where the past excitation may not have a strong periodic component, the stochastic codebook serves to generate the initial pulse and the adaptive codebook contribution is relatively much smaller. The linear-prediction analysis filter removes the short-time correlation from each frame of signal, with no concern regarding the periodicity of the residual generated. Small deviations from the periodicity of the speech signal may result in large aperiodicities in the residual signal. Such aperiodicities are considered detrimental to the resynthesis of the signal with good quality.

The non-linear filter along with a LPC inverse filter and a LPC synthesis filter is located at the outlet of a LPC analysis processor to alter the residual from the original PCM speech signal and noise input. The transfer function of the non-linear filter is such that only samples having amplitude less than a predetermined threshold will be attenuated. The degree of attenuation is a non-linear function of the sample amplitude. The higher the amplitude, the higher the attenuation will be. This approach has been found to be particularly effective in suppressing noise since samples of the residual signal that are below the amplitude threshold are, in all likelihood, noise.

In a most preferred embodiment, the amplitude threshold can be varied to suit the speech signal/noise ratio in the speech signal. A convenient way to estimate the amplitude threshold, above which no alteration to the residual signal is effected, is to calculate the standard deviation of the amplitude of a plurality of successive samples in the residual signal. Typically, the standard deviation is calculated over a full residual signal frame and the amplitude threshold value is then linearly computed from it. This calculation is effected at every signal frame, thus allowing the amplitude threshold to be dynamically updated in accordance with the variations of the residual signal.

As embodied and broadly described herein, the invention also provides a method for processing a residual signal capable of exciting a linear prediction filter to generate a replica of an audio signal, said method comprising the step of attenuating an amplitude of the residual signal according to a transfer function establishing a degree of amplitude attenuation that varies in accordance with an amplitude of the residual signal.

DESCRIPTION OF A PREFERRED EMBODIMENT

In communications applications where channel bandwidth is at a premium, it is essential to use the smallest possible portion of a transmission channel. A common solution is to compress the voice signal with an apparatus called a speech codec before it is transmitted on a RF channel.

Speech codecs, including an encoding and a decoding stage, are used to compress (and decompress) the digital signals at the source and reception point, respectively, in order to optimize the use of transmission channels. Codecs used specifically for voice signals are dubbed <<vocoders>> (for voice coders). By encoding only the necessary characteristics of a speech signal, fewer bits need to be transmitted than what is required to reproduce the original waveform in a manner that will not significantly degrade the speech quality. With fewer bits required, lower bit rate transmission can be achieved.

Figure 7A:
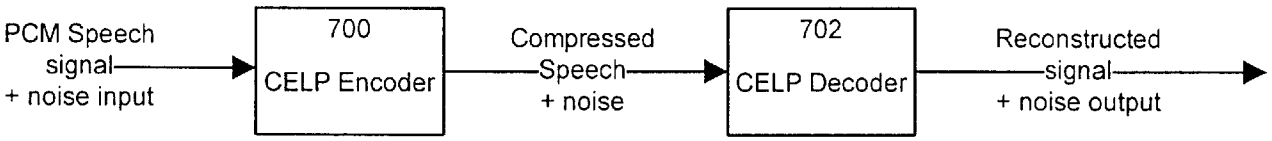
Figure 7a Prior art
FIG. 7*a* is a block diagram of a prior art CELP encoder/decoder.

A prior art speech encoder/decoder combination is depicted in FIG. 7*a*. A PCM speech signal is input to a CELP encoder 700 that processes the signal provided and produces representation of the signal in a compressed form. The compressed form comprises a coefficient segment and an excitation segment. The coefficient segment includes LPC coefficients. Those coefficients uniquely defines a filter function that models the human vocal tract. The excitation segment is defined as information that needs to be combined with the coefficient segment in order to provide a complete representation of the audio signal. Such excitation segment may include parametric information describing the periodicity of the speech signal, a residual as computed by the encoder of a vocoder, speech framing control information to ensure synchronous framing in the decoder associated with the remote vocoder, pitch periods, pitch lags, gains and relative gains, among others.

This information is then used to reproduce a PCM speech signal, along with the noise, by a CELP decoder 702.

The residual signal can be defined as the part of the speech signal that the encoder of the vocoder was not able to predict. The residual signal is a highly unpredictable waveform of relatively small power. The signal power divided by the power of the prediction residual is called the prediction gain. A normal value for the prediction gain is approximately 20 dB. The residual is therefore often described as being "spectrum flattened".

Code Excited Linear Prediction (CELP) vocoders are the most common type of vocoder used in telephony presently. Instead of sending the excitation parameters, CELP vocoders send index information that points to a set of vectors in an adaptive and stochastic code book. That is, for each speech signal, the encoder searches through its code book for the one that gives the best perceptual match to the sound when used as an excitation to the LPC synthesis filter.

Figure 1:
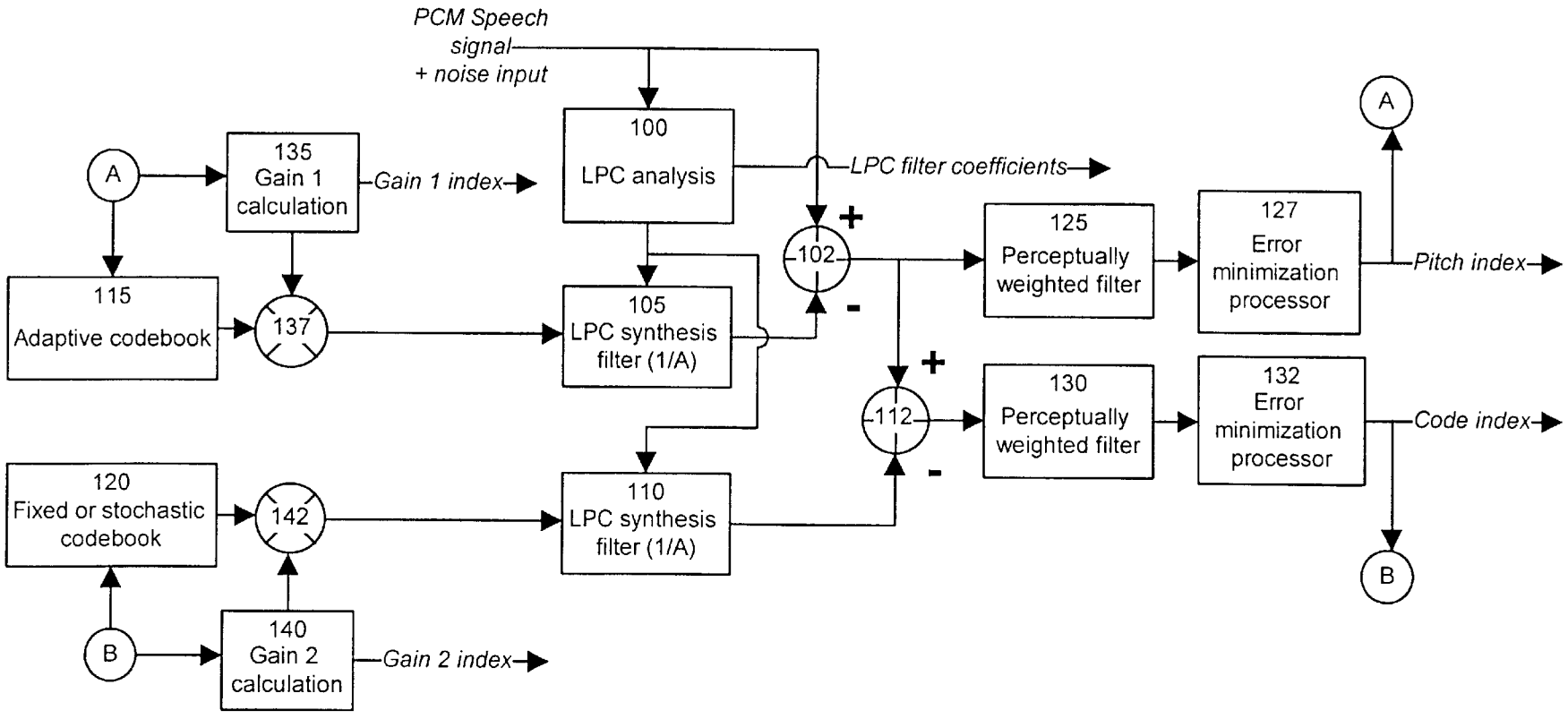
Figure 1 Prior art
FIG. 1 is a block diagram of the encoder stage of a CELP vocoder.

FIG. 1 is a block diagram of the encoder portion of a generic model for a CELP vocoder. As can be seen from this Figure, the only input is the PCM speech signal embedded with noise. This signal is input to the LPC analysis block 100 and to the adder 102. The LPC analysis block 100 outputs the LPC filter coefficients for transmission on the communication channel and as input to the LPC synthesis filter 105 and 110. At the adder 102, the output of the LPC synthesis filter 105 is subtracted from the PCM signal. The result is sent to a perceptually weighted filter 125 followed by an error minimization processor 127 that outputs the pitch index that will be transmitted on the communication channel. Those pitch indices are also sent back to the adaptive codebook 115 and to the first gain calculator 135 to effect a backward adaptation procedure, thus select the best waveform from the adaptive codebook to match the input speech signal. The first gain calculator 135 outputs the first gain indices to be transmitted over the communication channel and to be input to the multiplier 137. The adaptive codebook 115 outputs the periodic component of the residual to the multiplier 137 whose output is sent to the LPC synthesis filter 105.

At the adder 112, the output of the LPC synthesis filter 110 is subtracted from the output of the adder 102. The result is sent to the perceptually weighted filter 130 followed by an error minimization processor 132 that outputs the code index that is transmitted over the communication channel and also fed back to the stochastic codebook 120 and to the second gain calculator 140. The second gain calculator 140 outputs the second gain index that will be transmitted over the communication channel. The second gain index is used in the multiplier 142 with the output to the stochastic codebook 120, which is the statistic component of the residual signal.

Figure 2:
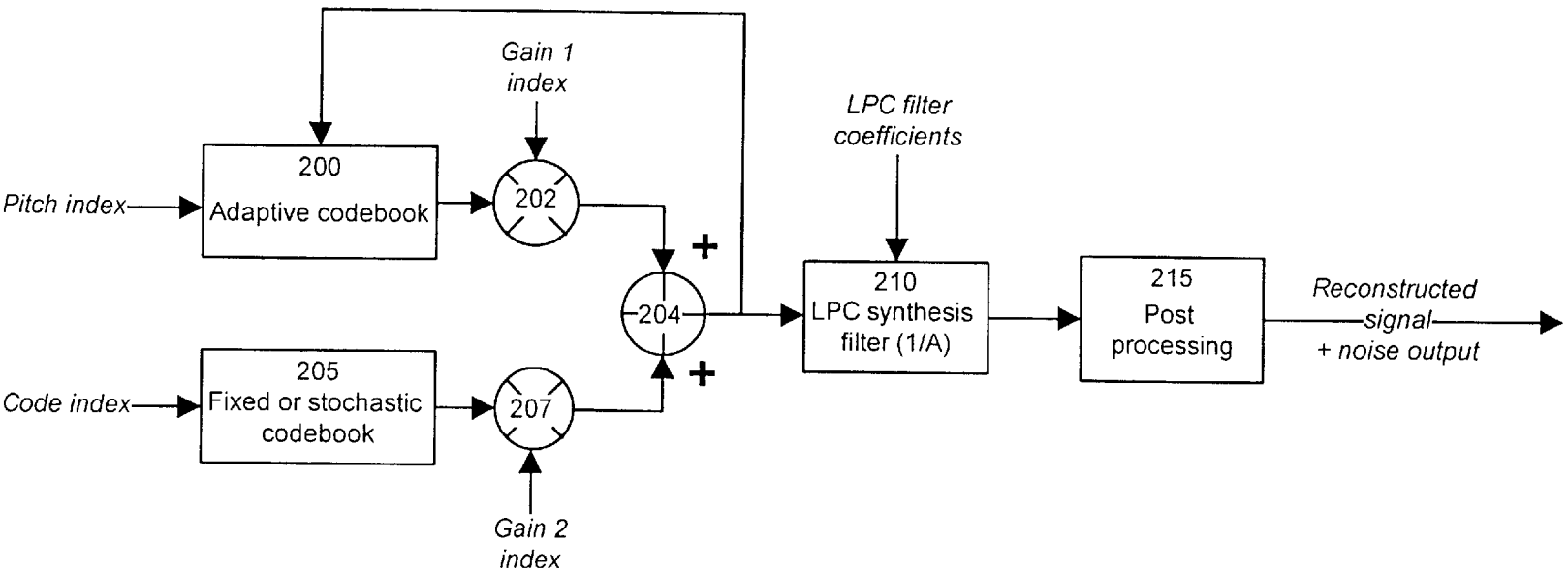
Figure 2 Prior art
FIG. 2 is a bloc diagram of the decoder stage of a CELP vocoder.

FIG. 2 is a block diagram of the decoder portion of a generic model for a CELP vocoder. The compressed speech frame is received from a telecommunication channel and fed to the different components of the decoder. The LPC coefficients are fed to an LPC synthesis filter 210. The pitch index is fed to the adaptive codebook 200 that calculates the periodic component of the residual with input from the last calculated residual. Its output is then multiplied with the first gain index by the multiplier 202. The code index is input to the stochastic codebook 205 that calculates the stochastic component of the residual and its output is multiplied with the second gain index by the multiplier 207. These two parts of the residual are then added in the adder 204 and fed to the LPC synthesis filter 210. The LPC synthesis filter then uses the LPC filter coefficients and the calculated residual to produce speech signal that goes through some post processing 215 before it is output, usually in a PCM sample form.

A segment exhibiting strong voicing is assumed to contain two additive components in the spectrum-flattened residual, a strong periodic component, due to the major pulses of the vocal tract excitation and an aperiodic noise component. This noise component represents the effects of spectrum-flattened environmental noise as well as minor secondary excitation pulses of the speech signal. The object of this invention is to achieve a relative suppression of the aperiodic component of the signal and thereby enhance the harmonic structure of the resynthesized speech. This result is obtained by nonlinear filtering the residual component of the compressed speech signal.

Previous work in this area dealt with the center-clipping technique for pitch lag determination. This work is covered in the article entitled "New methods of pitch extraction" by M.M Sondhi. The contents of this article are incorporated herein by reference. Center-clipping a speech signal corrupted by noise attenuates the noise component. However, distortions may be introduced into the speech signal due to a disturbance in the short term correlation properties, or, viewed in the frequency domain, distortions in successive short term spectra may result. An example of a center-clipping filter is given at FIG. 3*b*.

Another center-clipping technique was used by Taniguchi et al. To modify the adaptive codebook in CELP coding and thereby achieve pitch sharpening and is described in "Pitch sharpening for perceptually improved CELP and the sparse-delta codebook for reduced computation". This article is hereby incorporated by reference.

A nonlinear filter, is mathematically expressed by a non-linear equation. In the present invention this filter attenuates the amplitude of the residual signal samples to a degree that varies with the amplitude of the input signal, namely the residual signal that presumably contains noise. In general, the lower the amplitude, the higher the attenuation. The transfer function of a non-linear filter found satisfactory for the present invention is given by the following equation:

$$y(n)=A(n)x(n)$$

where $$A(n)=min(|x(n)/k|,1)$$

and x(n) and y(n) are sampled values of the input and output signals, respectively, and k is a suitable threshold value.

Another suitable form for a nonlinear filter equation would be:

$$A(n)=min(x^2(n)/k,l)$$

Figure 3A:
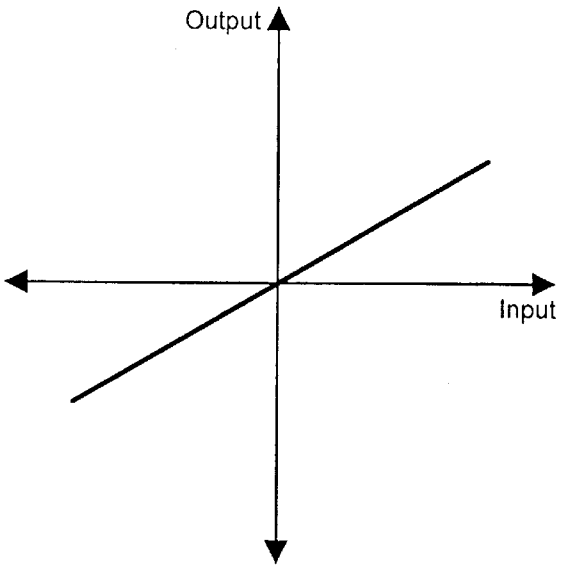
FIG. 3*a* is a graph illustrating the transfer function a linear filter.
Figure 3B:
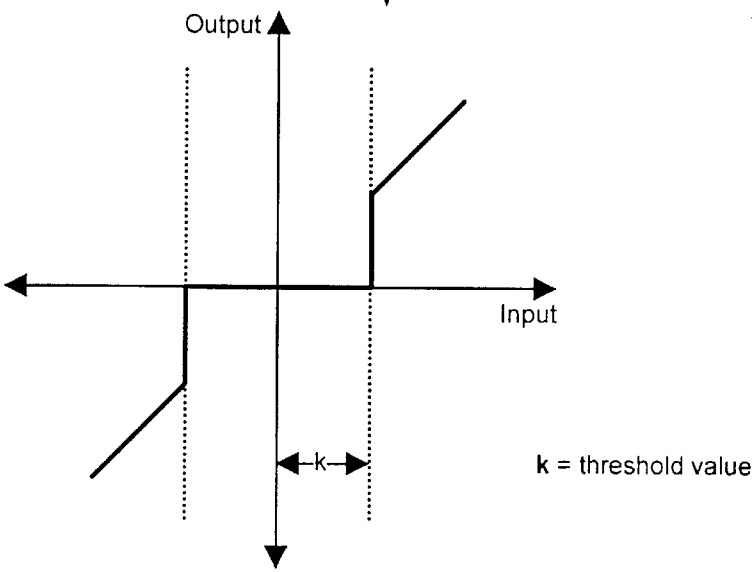
FIG. 3*b* is a graph illustrating the transfer function of a center-clipping filter.
Figure 3C:
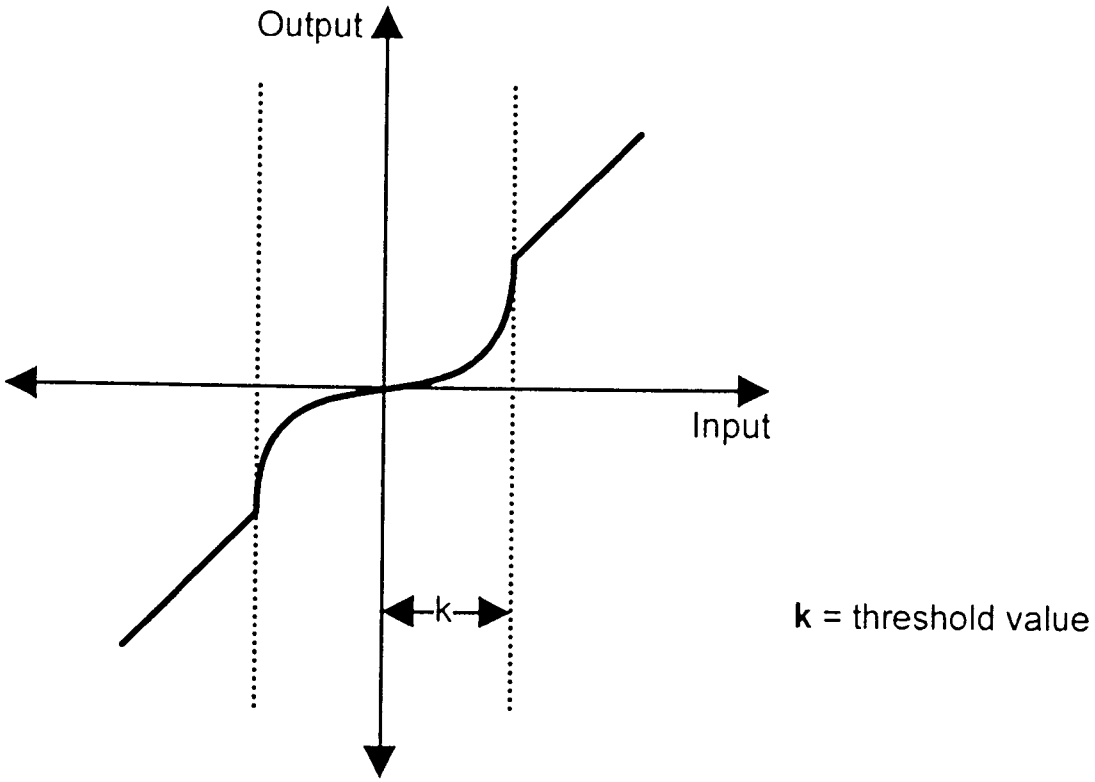
FIG. 3*c* is a graph illustrating the transfer function of a non-linear filter.

An example of the filter characteristics is given in FIG. 3*c*. The nonlinear filter equations above are example of the type of filter that can be used in this invention. Comparatively, a linear filter is one that can be mathematically expressed by a linear equation and an example of the characteristics of such a filter is shown in FIG. 3*a*.

The details of constructing a non-linear filter in accordance with the characteristics above will not be described in detail here since such filters are generally known to those skilled in the art.

Figure 4A:
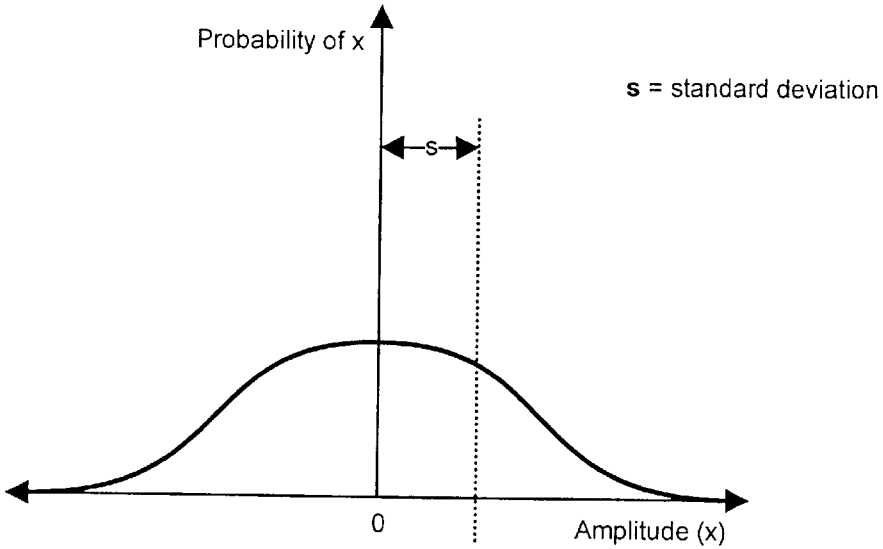
FIG. 4*a* is a graph showing a probability distribution function of the amplitude of a speech signal where the signal/noise ratio is high.
Figure 4B:
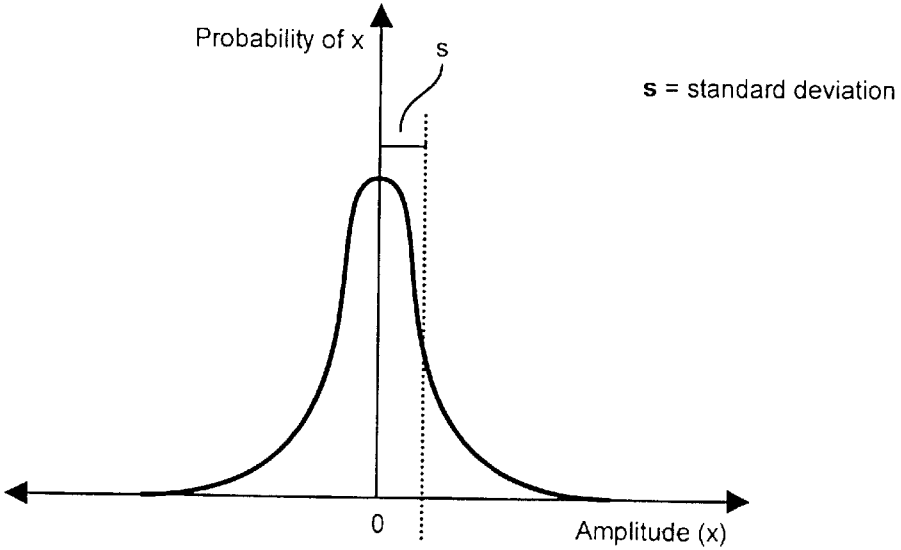
FIG. 4*b* is a graph showing a probability distribution function of the amplitude of a speech signal where the signal/noise ratio is low.

Notice that below an amplitude threshold k, the input is modified according to the nonlinear equation and that above the threshold, the output is simply equal to the input. The threshold k can be correlated to the standard deviation for each of the residual signal frames. For instance k may be the standard deviation over the residual signal frame multiplied by a constant. The threshold value k is meant to be variable such that when the amplitude of the speech is high relative to the noise amplitude, the standard deviation is high as well. This situation is depicted in FIG. 4*a*. Conversely, when the speech content is low relative to noise, the standard deviation is low as well. This situation is depicted in FIG. 4*b*. This implies that when the residual signal samples have high amplitude characteristics, the threshold will be high and only the larger amplitude signal samples will be retained after filtering, thus increasing the periodicity of the signal. When the residual signal samples have low amplitude characteristics, then the threshold will be low, thus only very small components of the signal samples, mainly noise, will be filtered and the result will again be increased periodicity, hence improved speech quality.

Figure 5:
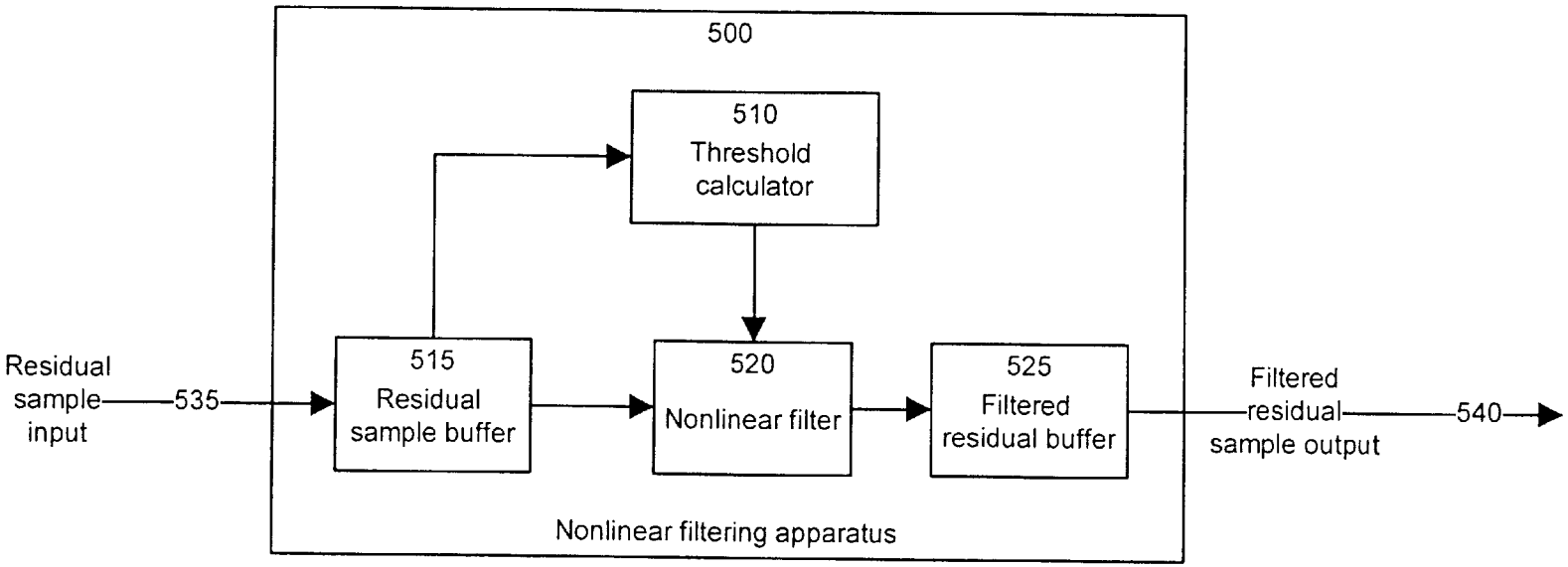
FIG. 5 is a block diagram of a non-linear filtering apparatus functioning in accordance with the principles of the invention and the method detailed in FIG. 6.

A possible embodiment for a nonlinear filtering apparatus as described above is depicted in FIG. 5. The nonlinear filtering apparatus 500 has a threshold calculator 510, a residual sample buffer 515, a nonlinear filter 520 and a filtered residual buffer 525. One input is provided to the nonlinear filtering apparatus 500. It is the residual samples 535. The output is the result of the nonlinear filtered residual samples 540 using a linear computation of the standard deviation of the residual samples over a frame as the amplitude threshold.

The two buffers (515 and 525) are simply temporary storage elements that keep the required information for a period equal to a speech frame. The threshold calculator 510 takes its information from the residual sample buffer and calculates the standard deviation for one PCM sample of the residual signal. It then calculates the value k, such as by multiplying the standard deviation value by a suitable constant. The threshold calculator 510 sends this information to the nonlinear filter 520 that uses it as its threshold value.

Figure 6:
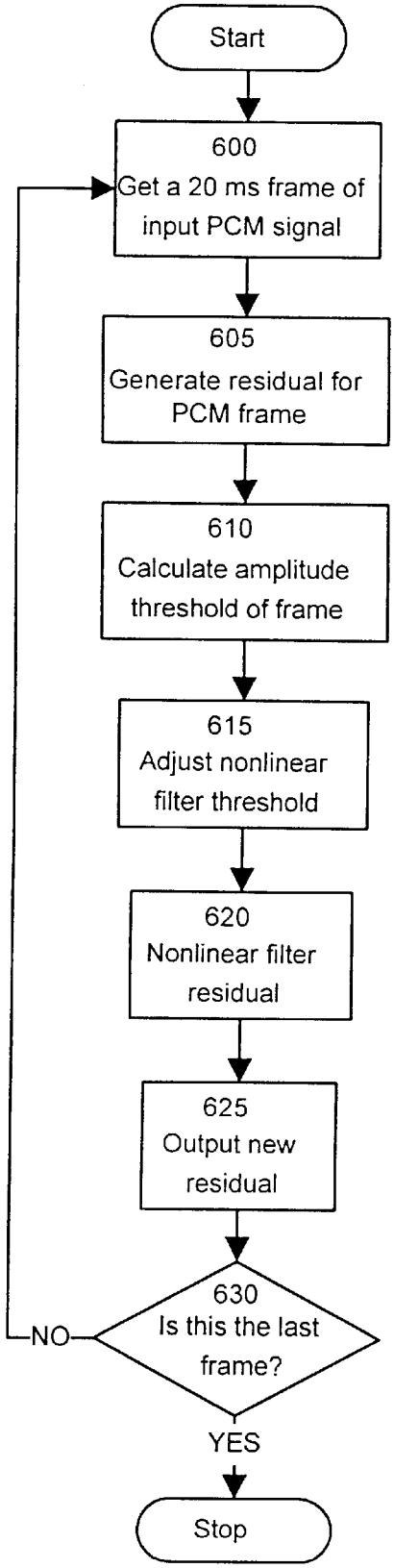
FIG. 6 is a flowchart of the method for performing signal processing in accordance with the invention.

The flowchart of FIG. 6 describes the method that implements a nonlinear filtering apparatus. At step 600, the apparatus gets a 20 millisecond frame of speech signal embedded with noise in the PCM format. A residual is generated for each frame (step 605) and input to the buffer 515. The amplitude threshold for that sample is then calculated (step 610). The filter threshold is adjusted accordingly (step 615). The residual is input to the nonlinear filter (step 620) and the resulting output is a new residual (step 625). At step 630, the apparatus verifies if this is the last frame. If it is, the apparatus returns to step 600 to get the next 20 millisecond sample. If it is not, the procedure is stopped.

Four examples of locations in which the nonlinear filtering apparatus 500 may be introduced are given in FIGS. 7*b* to 7*e*. The nonlinear filter apparatus can be either implemented on the encoder side (as in FIGS. 7*b* and 7*d*) or the decoder side (as in FIGS. 7*c* and 7*e*).

Figure 7B:
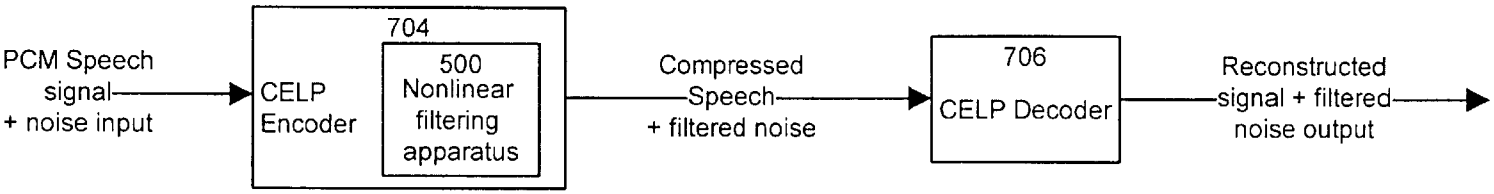
FIG. 7*b* is a block diagram of a CELP encoder utilizing the non-linear filter in accordance with the invention.
Figure 7C:
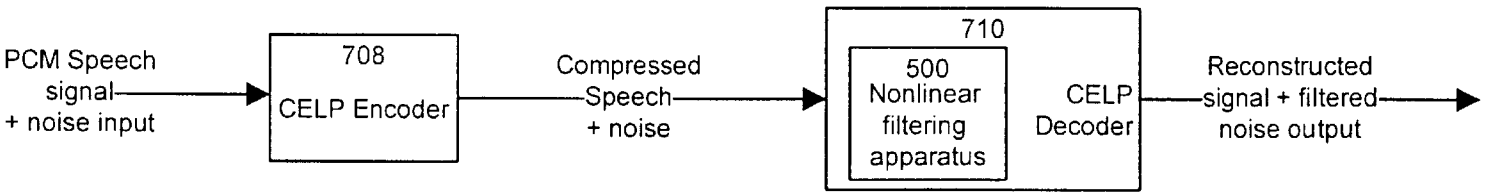
FIG. 7*c* is a block diagram of a CELP decoder utilizing the non-linear filter in accordance with the invention.
Figure 7D:
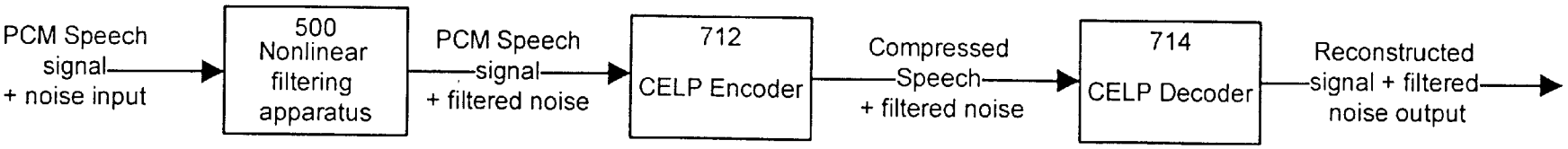
FIG. 7*d* is a block diagram of an audio signal encoding apparatus utilizing the non-linear filter in accordance with the invention where the filter is separate from the encoder structure.
Figure 7E:
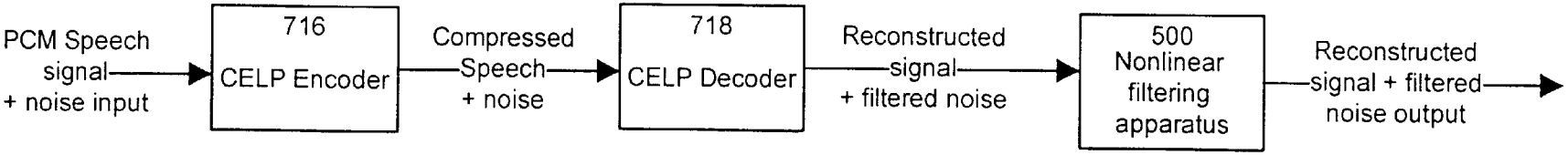
FIG. 7*e* is a block diagram of an audio signal decoding apparatus utilizing the non-linear filter in accordance with the invention where the filter is separate from the decoder structure.

FIG. 7*b* depicts a proposed implementation of the nonlinear filtering apparatus 500 on the encoder side 704 when access to it is provided. FIG. 7*c* depicts a proposed implementation of the nonlinear filtering apparatus on the decoder side 708 when access to it is provided. FIG. 7*d* depicts a proposed implementation when the nonlinear filtering apparatus 500 is placed before the encoder 712 when access to it is not provided. FIG. 7*e* depicts a proposed implementation of the nonlinear filtering apparatus 500 after the decoder 718 when access to it is not provided.

FIGS. 8 through 11 give a more detailed view of the possible implementation for the nonlinear filtering apparatus 500 and their descriptions are provided below.

Figure 8:
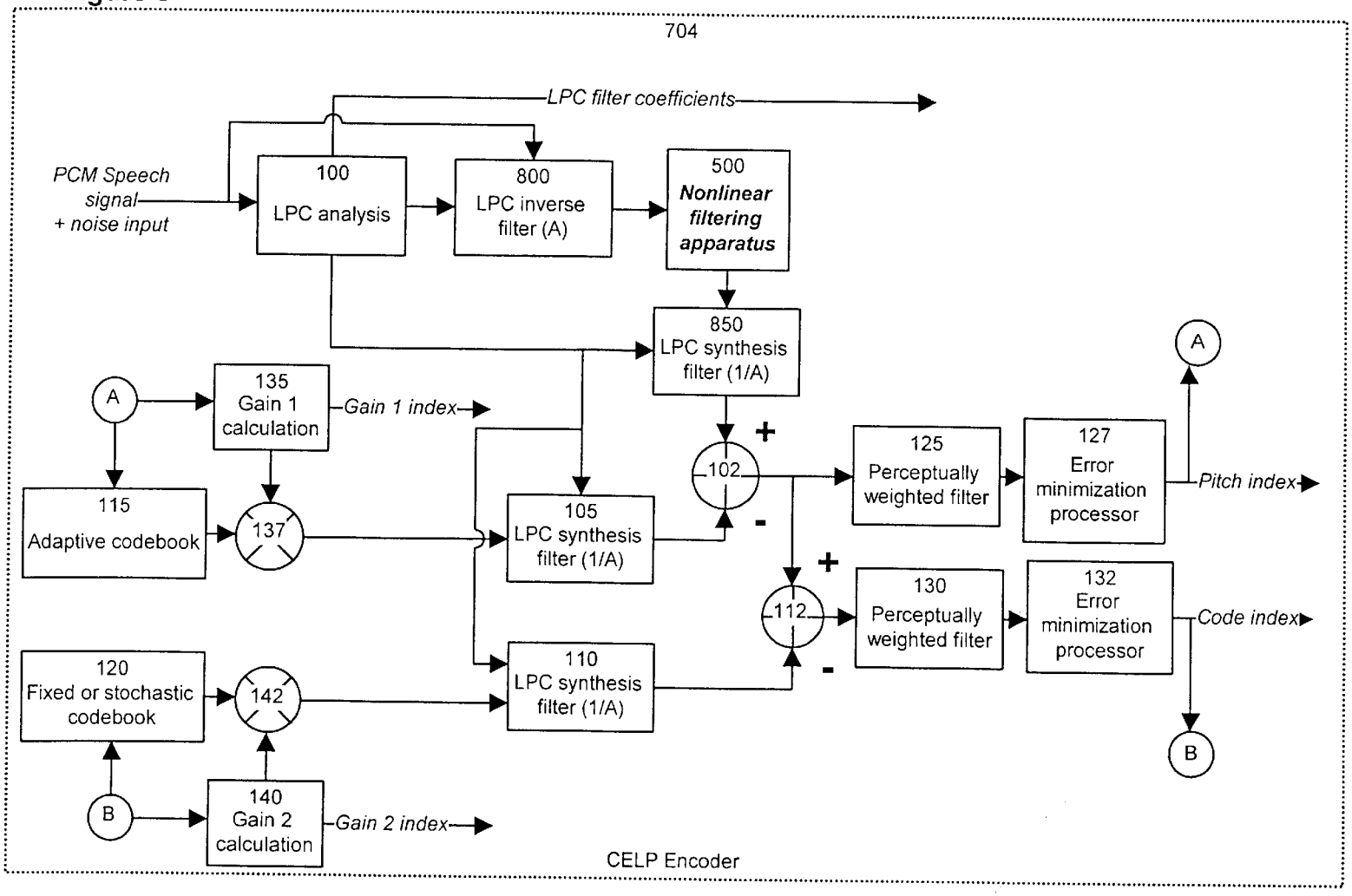
FIG. 8 is a block diagram showing the implementation of FIG. 7*b* in more detail.

The most preferred embodiment is shown in FIG. 8. If access is provided to modify the encoder, the nonlinear filtering apparatus 500 may be inserted along with a LPC inverse filter 800, that receives the LPC coefficients from the LPC analysis block 100 and outputs a residual signal, and a LPC synthesis filter 850 as input to the adder 102. The output of the nonlinear filtering apparatus 500 is a modified residual that is input to the LPC synthesis filter 850. The rest of the vocoder remains the same. The particular reason for which it is preferred is because it suppresses both coding and environmental noise without introducing signal delays.

Figure 9:
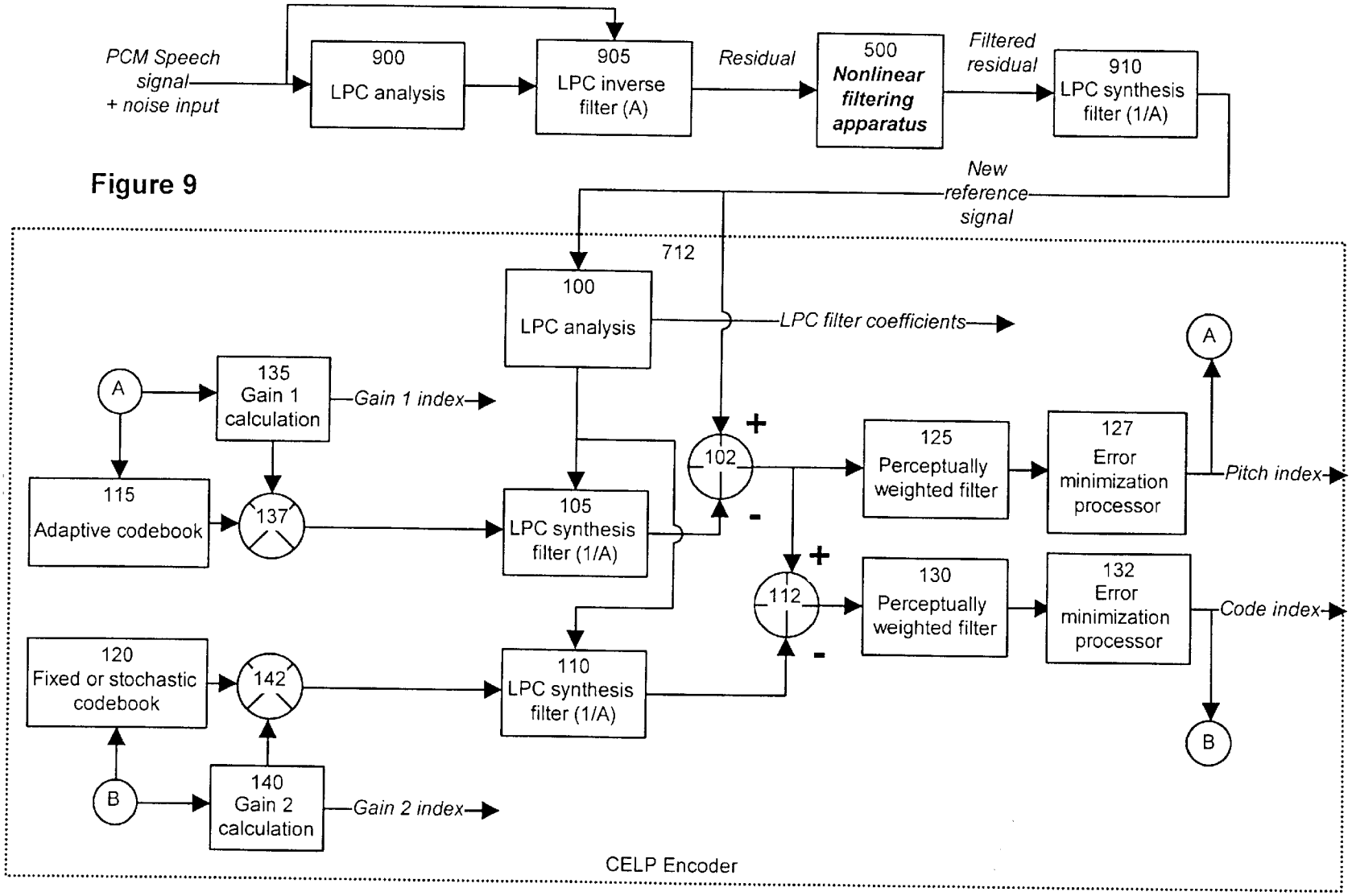
FIG. 9 is a block diagram showing the implementation of FIG. 7*c* in more detail.

As shown in FIG. 9, if access to the encoder 712 is not provided, the nonlinear filtering apparatus 500 can be used to provide a modified signal as the reference to be matched. In this case a PCM speech signal and its noise are input to a LPC analysis block 900 that produces the LPC coefficient to input to the LPC inverse filter 905 that in turn produces a residual. The residual is nonlinear filtered (apparatus 500) and passed through a LPC synthesis filter (910) which provides the new reference signal that is input to the LPC analysis block 100 and the adder 102. The additional processing required in this case will result in a signal delay.

Figure 10:
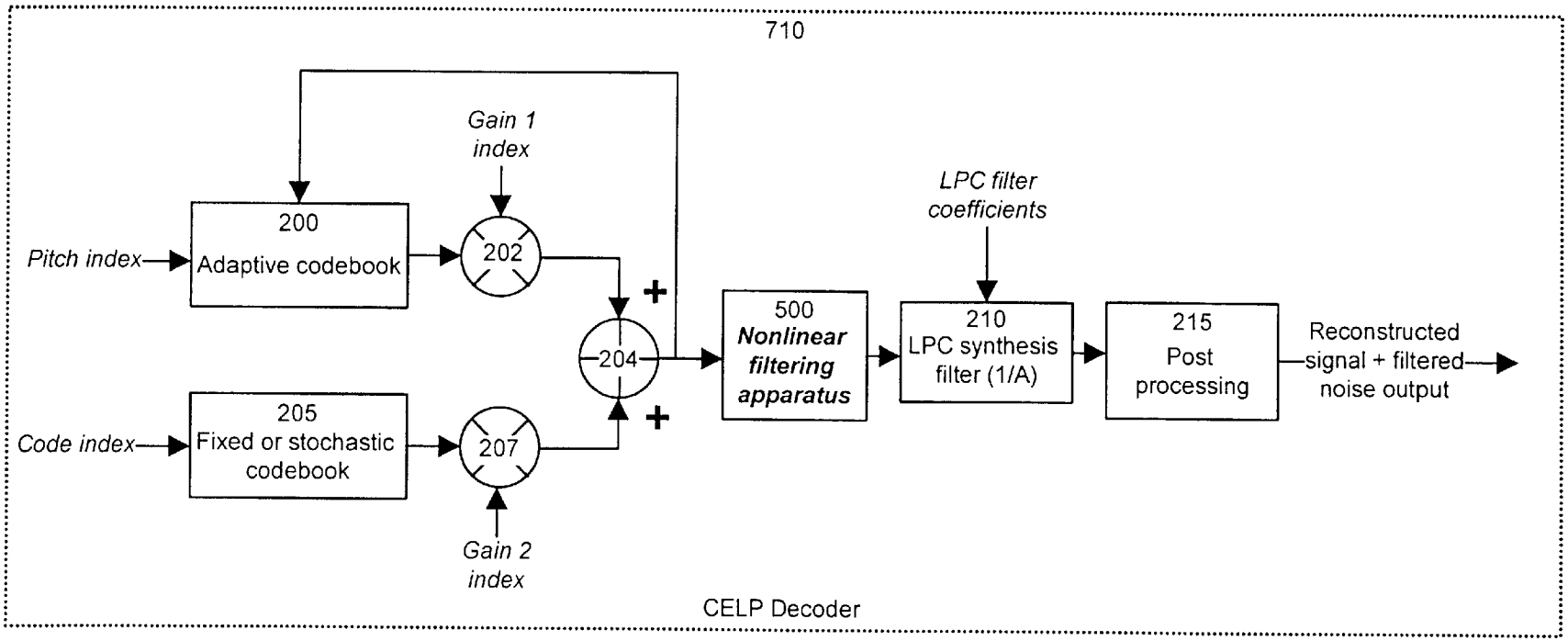
FIG. 10 is a block diagram showing the implementation of FIG. 7*d* in more detail.

The implementations are also different if access is provided to the decoder or not. If it is, the nonlinear filtering apparatus 500 is inserted immediately before the LPC synthesis filter 210 of the decoder 710 as shown in FIG. 10.

Figure 11:
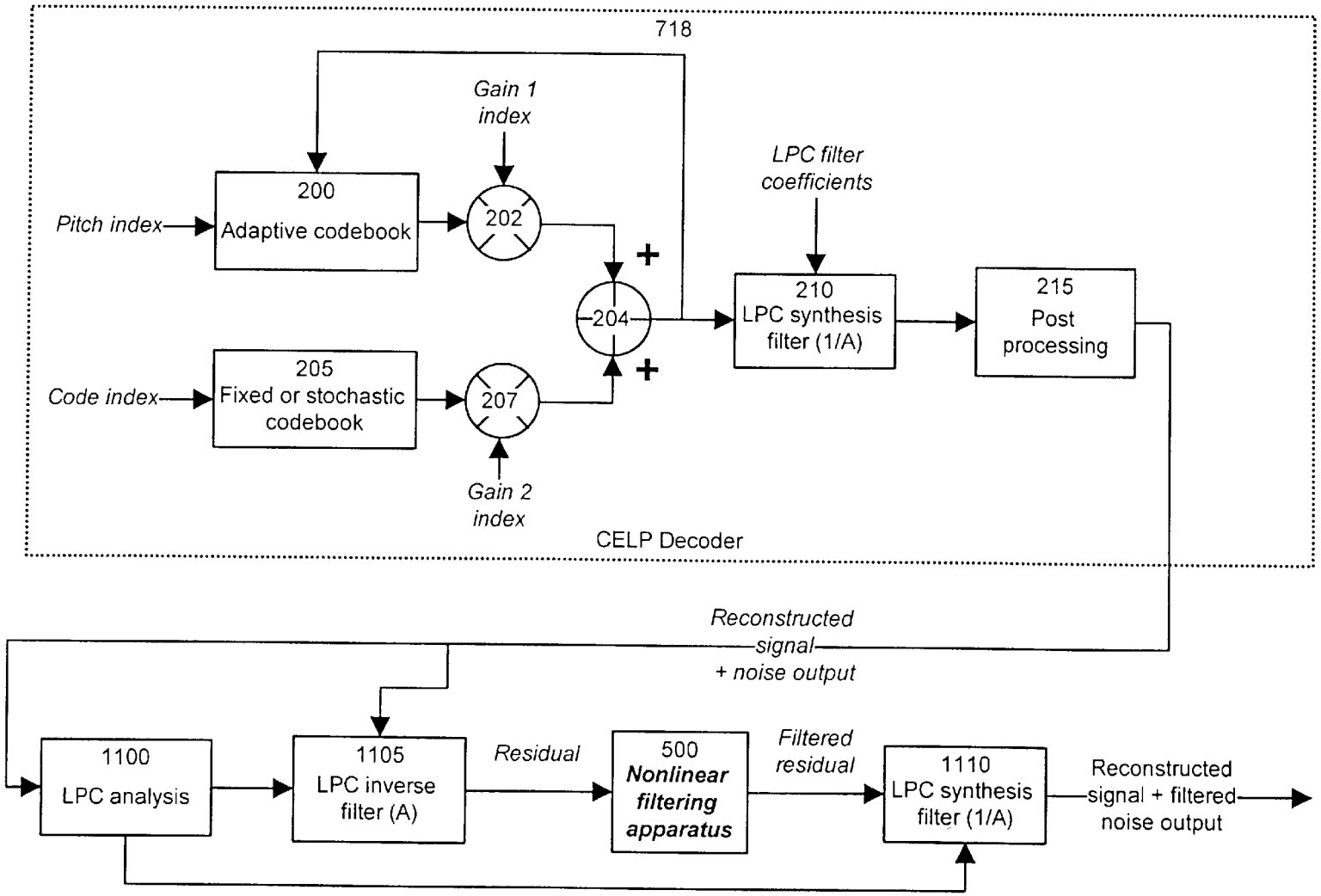
FIG. 11 is a block diagram showing the implementation of FIG. 7*e* in more detail.

When access to the decoder 718 is not available, the implementation is such as represented at FIG. 11. The decoder 718 produces a reconstructed signal along with its noise output. This signal is input to a LPC analysis processor 1100 which provides coefficients to an LPC inverse filter 1105 and a LPC synthesis filter 1110. The PCM signal is then passed through the LPC inverse filter 1105 and a residual is produced. This residual is nonlinear filtered (apparatus 500) and then passed through an LPC synthesis filter 1110. The LPC synthesis filter 1110 reconstructs the speech signal with a filtered noise output.

In other applications where digital speech transmission is not involved, the nonlinear filtering apparatus 500 can be used as a generalized noise suppressor. The embodiment would then be the same as in FIG. 11. That is, the input a PCM speech signal embedded with noise and the output is a reconstructed signal with nonlinear filtered noise. The setup would involve a LPC analysis processor 1100, and a LPC inverse filter 1105, a LPC synthesis filter 1110 and the nonlinear filtering apparatus 500. This embodiment also allows use of the noise suppressor as a prefilter to other coding systems, reducing the environmental noise that has become mixed with the received speech signal.

The above description of a preferred embodiment should not be interpreted in any limiting manner since variations and refinements can be made without departing from the spirit of the invention. The scope of the invention is defined in the appended claims and their equivalents.

I claim:

1. In an audio signal processing apparatus including means for generating a residual signal capable of exciting a linear prediction filter to generate a replica of an audio signal, the improvement comprising a non-linear filter that includes:

an input for receiving the residual signal;

a residual signal processing means coupled to said input for receiving the residual signal, said residual signal processing means having a transfer function that causes an attenuation of the residual signal, said transfer function establishing a degree of amplitude attenuation that varies in accordance with an amplitude of the residual signal; and an output coupled to said residual signal processing means for outputting the residual signal altered by said residual signal processing means.

2. The improvement as defined in claim 1, wherein said residual signal processing means causes attenuation of samples of the residual signal having an amplitude not exceeding a certain threshold k.

3. The improvement as defined in claim 2, wherein said transfer function is linear for samples having an amplitude exceeding said threshold k.

4. The improvement as defined in claim 2, wherein k is variable for each frame.

5. The improvement as defined in claim 4, wherein said residual signal processing means includes means for periodically re-computing a value for k.

6. The improvement as defined in claim 5, wherein said means for periodically re-computing a value for k includes means for computing a standard deviation of a plurality of samples of the residual signal.

7. The improvement as defined in claim 6, wherein the plurality of samples of the residual signal define a frame of the signal.

8. The improvement as defined in claim 7, wherein said means for computing a standard deviation, effects a computation of a standard deviation over a frame of the residual signal.

9. The improvement as defined in claim 2, wherein said transfer function is defined by:

$$y(n)=A(n)x(n)$$

where $$A(n)=min(|x(n)/k|,l)$$

and x(n) and y(n) are sampled values of the input and output signals, respectively, and k is the amplitude threshold value.

10. The improvement as defined in claim 1, wherein said audio processing apparatus is a voice encoder.

11. The improvement as defined in claim 10 wherein said encoder is of a CELP type.

12. The improvement as defined in claim 1, wherein said audio processing apparatus is a voice decoder.

13. The improvement as defined in claim 12, wherein said decoder is of the CELP type.

14. The improvement as defined in claim 1, wherein said audio processing apparatus includes a synthesis filter coupled to said output.

15. The improvement as defined in claim 14, wherein said synthesis filter is a linear prediction filter.

* * * * *